US010902785B2

(12) United States Patent
Wang

(10) Patent No.: US 10,902,785 B2
(45) Date of Patent: Jan. 26, 2021

(54) PIXEL DRIVING CIRCUIT

(71) Applicant: Wuhan China Star Optoelectronics Semiconductor Display Technology Co., LTD., Wuhan (CN)

(72) Inventor: Hai Wang, Wuhan (CN)

(73) Assignee: Wuhan China Star Optoelectronics Semiconductor Display Technology Co., LTD., Wuhan (CN)

( * ) Notice: Subject to any disclaimer, the term of this patent is extended or adjusted under 35 U.S.C. 154(b) by 0 days.

(21) Appl. No.: 16/633,471

(22) PCT Filed: Jul. 19, 2019

(86) PCT No.: PCT/CN2019/096892
§ 371 (c)(1),
(2) Date: Jan. 23, 2020

(65) Prior Publication Data

US 2020/0388223 A1 Dec. 10, 2020

(30) Foreign Application Priority Data

Jun. 10, 2019 (CN) ..... 2019 1 0498193

(51) Int. Cl.
*G09G 3/3258* (2016.01)

(52) U.S. Cl.
CPC ... *G09G 3/3258* (2013.01); *G09G 2300/0842* (2013.01); *G09G 2320/02* (2013.01)

(58) Field of Classification Search
CPC ..... G09G 3/3258; G09G 3/3225; G09G 2300/0842
See application file for complete search history.

(56) References Cited

U.S. PATENT DOCUMENTS

2011/0148849 A1* 6/2011 Jang ..... G09G 3/20 345/213

FOREIGN PATENT DOCUMENTS

CN 111341245 A * 6/2020 ..... G09G 3/20

* cited by examiner

*Primary Examiner* — Laurence J Lee
(74) *Attorney, Agent, or Firm* — Neugeboren O'Dowd PC

(57) ABSTRACT

A pixel driving circuit for an organic light-emitting diode (OLED) display panel is provided. The circuit includes a restoration module, a compensation module including a storage capacitor, a light-emitting module, and a storage capacitor control module. The restoration module receives a first control signal and a restoration voltage and restores the compensation module and the light-emitting module under the control of the first control signal. The compensation module receives a second control signal, and writes a data signal and compensates a threshold voltage under the control of the second control signal. The light-emitting module receives a third control signal and illuminates under the control of the third control signal. The storage capacitor control module adjusts a capacitance value of the storage capacitor in the compensation module according to different refresh frequencies of the OLED display panel, preventing insufficient charging due to an increasing refresh frequency.

10 Claims, 2 Drawing Sheets

PIXEL DRIVING CIRCUIT

BACKGROUND OF DISCLOSURE

1. Field of Disclosure

The present disclosure relates to the field of display technology, and more particularly, to a pixel driving circuit.

2. Description of Related Art

Organic light emitting diode (OLED) display devices are regarded as the most promising display devices due to their advantages such as being self-luminous, having a low driving voltage, a high luminous efficiency, a short response time, high sharpness, a high contrast, a nearly 180-degree viewing angle, a wide using temperature range, being able to achieve flexible display and large-area full-color display, etc.

According to driving methods, OLED display devices can be categorized into two major types, which are passive matrix OLED (PMOLED) and active matrix OLED (AMOLED), i.e., a direct addressing type and a thin-film transistor (TFT) matrix addressing type. An AMOLED display device has pixels arranged in an array and belongs to an active displaying type. In general, AMOLED display devices are used as large-sized display devices with high resolution due to a high luminous efficiency.

When currents flow through OLEDs, the OLEDs shine for AMOLEDs are devices driven by currents. In addition, their brightness is determined by the currents flowing through the OLEDs. As most of conventional integrated circuits (ICs) are only for transmitting voltage signals, the pixel driving circuits of AMOLEDs need to transfer the voltage signals into current signals. In general, conventional pixel driving circuits of AMOLEDs are of a 2T1C structure, that is, two thin-film transistors and a capacitor, which can transfer voltages into currents.

With the development of display technology, an users' demand for a refresh frequency of the display panel becomes higher and higher. At present, a mainstreaming refresh frequency of 60 Hz can not satisfy the users' demand. A high refresh frequency of 90 Hz or 120 Hz is increasingly used in various scenes. A period of 6.94μs is required to scan one row of pixels using a refresh frequency of 60 Hz, only 4.63 μs is left to scan one row of pixels using a refresh frequency of 90 Hz, and only 3.4 μs is left to scan one row of pixels using a refresh frequency of 120 Hz. Currently, pixel driving circuits of OLED display panels substantially have only one storage capacitor with a fixed capacitance value, so the capacitance value of the storage capacitor cannot be adjusted according to a change of the refresh frequency of the display panel. With a high refresh frequency, a scanning time is reduced, easily leading to insufficient charging and abnormal pictures.

SUMMARY

The object of the present disclosure is to provide a pixel driving circuit, which can adjust a storage capacitance according to a change of a refresh frequency of an organic light emitting diode (OLED) display panel, preventing insufficient charging due to an increasing refresh frequency.

In order to realize the above object, the present disclosure provides a pixel driving circuit for an organic light-emitting diode (OLED) display panel, the pixel driving circuit including: a restoration module; a compensation module electrically connected to the restoration module, the compensation module including a storage capacitor; a light-emitting module electrically connected to the restoration module; and a storage capacitor control module electrically connected to the compensation module.

The restoration module is configured to receive a first control signal and a restoration voltage and be controlled by the first control signal to transmit the restoration voltage to the compensation module and the light-emitting module in order to restore the compensation module and the light-emitting module.

The compensation module is configured to receive a second control signal and be controlled by the second control signal to write a data signal and to compensate a threshold voltage.

The light-emitting module is configured to receive a third control signal and be controlled by the third control signal to illuminate.

The storage capacitor control module is configured to adjust a capacitance value of the storage capacitor in the compensation module according to a difference of refresh frequencies of the OLED display panel.

The storage capacitor control module receives a first capacitance control signal and a second capacitance control signal and adjusts the capacitance value of the storage capacitor in the compensation module by varying potential of the first capacitance control signal and the second capacitance control signal.

The storage capacitor control module includes an eighth thin-film transistor and a ninth thin-film transistor.

A gate electrode of the eighth thin-film transistor receives the first capacitance control signal, a source electrode of the eighth thin-film transistor receives a high potential of power, and a drain electrode of the eighth thin-film transistor is electrically connected to the compensation module.

A gate electrode of the ninth thin-film transistor receives the second capacitance control signal, a source electrode of the ninth thin-film transistor receives the high potential of power, and a drain electrode of the ninth thin-film transistor is electrically connected to the compensation module.

The compensation module further includes a first thin-film transistor, a second thin-film transistor, and a third thin-film transistor, and the storage capacitor includes a first capacitor and a second capacitor.

A gate electrode of the first thin-film transistor is electrically connected to a second end of the first capacitor, a source electrode of the first thin-film transistor is electrically connected to a drain electrode of the second thin-film transistor, and a drain electrode of the first thin-film transistor is electrically connected to a drain electrode of the third thin-film transistor.

A gate electrode of the second thin-film transistor receives the second control signal, and a source electrode of the second thin-film transistor receives the data signal.

A gate electrode of the third thin-film transistor receives the second control signal, and a source electrode of the third thin-film transistor is electrically connected to the gate electrode of the first thin-film transistor.

A first end of the first capacitor is electrically connected to the drain electrode of the eighth thin-film transistor, and a second end of the first capacitor is electrically connected to the gate electrode of the first thin-film transistor.

A first end of the second capacitor is electrically connected to the drain electrode of the ninth thin-film transistor, and the second end of the second capacitor is electrically connected to the gate electrode of the first thin-film transistor.

A capacitance value of the first capacitor is greater than a capacitance value of the second capacitor.

When a refresh frequency of the OLED display panel is less than or equal to 60 Hz, the eighth thin-film transistor and the ninth thin-film transistor are controlled by the first capacitance control signal and the second capacitance control signal to be both turned on.

When the refresh frequency of the OLED display panel is greater than 60 Hz and is less than or equal to 90 Hz, the eighth thin-film transistor is controlled by the first capacitance control signal to be turned on, and the ninth thin-film transistor is controlled by the second capacitance control signal to be turned off.

When the refresh frequency of the OLED display panel is greater than 90 Hz, the eighth thin-film transistor is controlled by the first capacitance control signal to be turned off, and the ninth thin-film transistor is controlled by the second capacitance control signal to be turned on.

The restoration module includes a fourth thin-film transistor and a seventh thin-film transistor.

A gate electrode of the fourth thin-film transistor receives the first control signal, a source electrode of the fourth thin-film transistor receives the restoration voltage, and a drain electrode of the fourth thin-film transistor is electrically connected to the gate electrode of the first thin-film transistor.

A gate electrode of the seventh thin-film transistor receives the first control signal, a source electrode of the seventh thin-film transistor receives the restoration voltage, and a drain electrode of the seventh thin-film transistor is electrically connected to the light-emitting module.

The light-emitting module includes a fifth thin-film transistor, a sixth thin-film transistor, and an organic light-emitting diode.

A gate electrode of the fifth thin-film transistor receives the third control signal, a source electrode of the fifth thin-film transistor receives the high potential of power, and a drain electrode of the fifth thin-film transistor is electrically connected to the drain electrode of the first thin-film transistor.

A gate electrode of the sixth thin-film transistor receives the third control signal, a source electrode of the sixth thin-film transistor is electrically connected to the drain electrode of the first thin-film transistor, and a drain electrode of the sixth thin-film transistor is electrically connected to an anode of the organic light-emitting diode.

The anode of the organic light-emitting diode is electrically connected to the drain electrode of the seventh thin-film transistor, and a cathode of the organic light-emitting diode receives a low potential of power.

The first thin-film transistor, the second thin-film transistor, the third thin-film transistor, the fourth thin-film transistor, the fifth thin-film transistor, the sixth thin-film transistor, and the seventh thin-film transistor are P-type thin-film transistors.

Potential of the first control signal, the second control signal, and the third control signal cooperates with each other to cause the pixel driving circuit to progress into a restoration stage, a threshold voltage compensation stage, and a light-emitting stage sequentially.

At the restoration stage, potential of the first control signal is low, and potential of the second control signal and the third control signal is high.

At the threshold voltage compensation stage, potential of the second control signal is low, and potential of the first control signal and the third control signal is high.

At the light-emitting stage, potential of the third control signal is low, and potential of the first control signal and the second control signal is high.

The beneficial effect of the present disclosure is that, the present disclosure provides a pixel driving circuit for an OLED display panel, the pixel driving circuit including: a restoration module; a compensation module electrically connected to the restoration module, the compensation module including a storage capacitor; a light-emitting module electrically connected to the restoration module; and a storage capacitor control module electrically connected to the compensation module; wherein the restoration module is configured to receive a first control signal and a restoration voltage and be controlled by the first control signal to transmit the restoration voltage to the compensation module and the light-emitting module in order to restore the compensation module and the light-emitting module; wherein the compensation module is configured to receive a second control signal and be controlled by the second control signal to write a data signal and to compensate a threshold voltage; wherein the light-emitting module is configured to receive a third control signal and be controlled by the third control signal to illuminate; and wherein the storage capacitor control module is configured to adjust a capacitance value of the storage capacitor in the compensation module according to a difference of refresh frequencies of the OLED display panel. The present disclosure configures the storage capacitor control module to adjust the capacitance value of the storage capacitor in the compensation module according to the difference of refresh frequencies of the OLED display panel, preventing insufficient charging due to an increasing refresh frequency and thus improving stability of the pixel driving circuit.

BRIEF DESCRIPTION OF DRAWINGS

In order to understand the features and the technical content of the present disclosure further, please refer to the detailed explanation and the accompanying drawings of the present disclosure as follows. However, the accompanying drawings are merely for reference and explanation without limiting the present disclosure.

The accompanying drawings are as follows.

DETAILED DESCRIPTION OF EMBODIMENTS

In order to explain the technical solutions and the effects of the present disclosure further, they will be described in conjunction with preferred embodiments and the accompanying drawings of the present disclosure in detail below.

Figure 1:
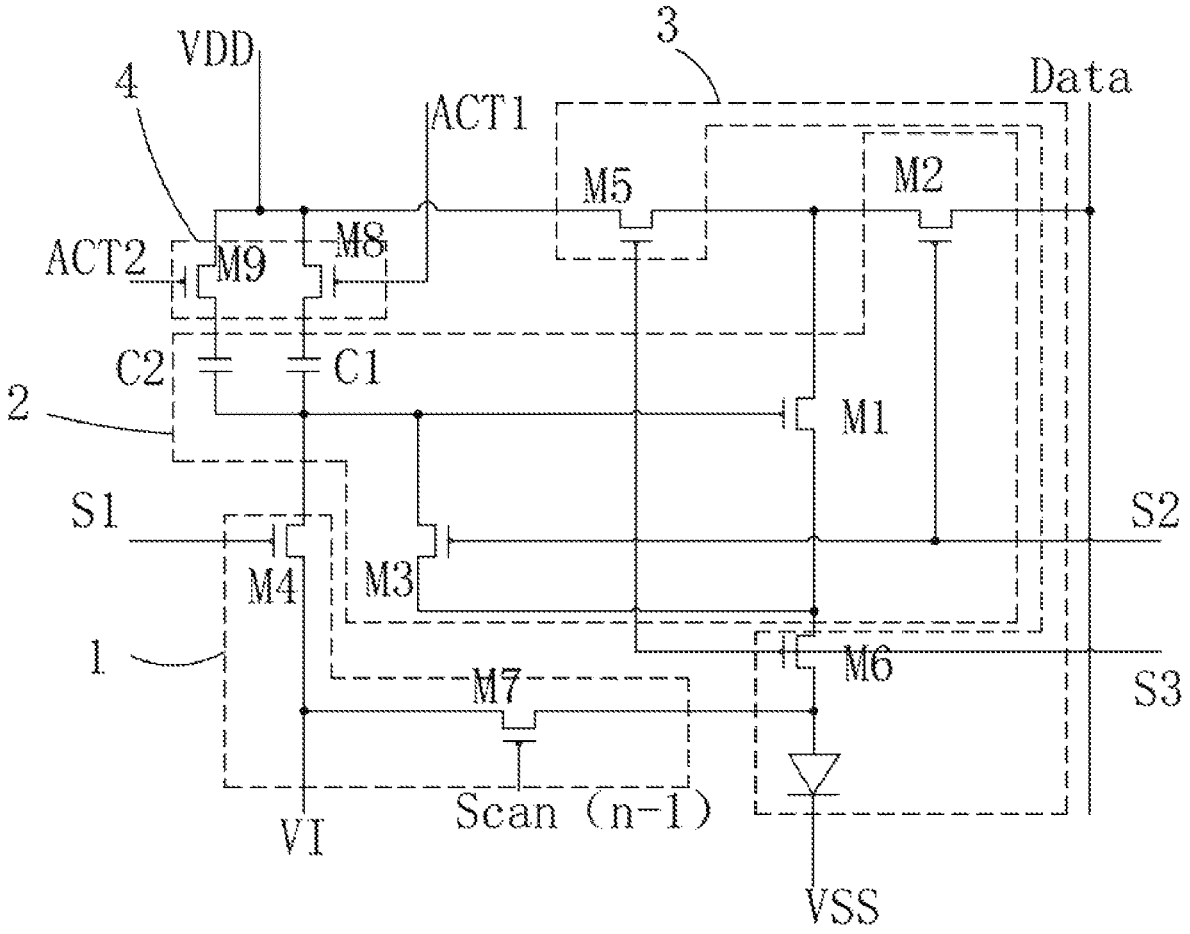
FIG. 1 is a circuit diagram of a pixel driving circuit according to the present disclosure.

Please refer to FIG. 1, the present disclosure provides a pixel driving circuit for an organic light-emitting diode (OLED) display panel, the pixel driving circuit including a restoration module 1, a compensation module 2 electrically connected to the restoration module 1, a light-emitting module 3 electrically connected to the restoration module 1, and a storage capacitor control module 4 electrically connected to the compensation module 2. The compensation module 2 includes a storage capacitor.

The restoration module 1 is configured to receive a first control signal S1 and a restoration voltage VI and be controlled by the first control signal S1 to transmit the restoration voltage VI to the compensation module 2 and the light-emitting module 3 in order to restore the compensation module 2 and the light-emitting module 3.

The compensation module 2 is configured to receive a second control signal S2 and be controlled by the second control signal S2 to write a data signal Data and to compensate a threshold voltage.

The light-emitting module 3 is configured to receive a third control signal S3 and be controlled by the third control signal S3 to illuminate.

The storage capacitor control module 4 is configured to adjust a capacitance value of the storage capacitor in the compensation module 2 according to a difference of refresh frequencies of the OLED display panel.

Specifically, the storage capacitor control module 4 receives a first capacitance control signal ACT1 and a second capacitance control signal ACT2 and adjusts the capacitance value of the storage capacitor in the compensation module 2 by varying potential of the first capacitance control signal ACT1 and the second capacitance control signal ACT2.

Further, in a preferred embodiment of the present disclosure, the storage capacitor control module 4 includes an eighth thin-film transistor M8 and a ninth thin-film transistor M9. A gate electrode of the eighth thin-film transistor M8 receives the first capacitance control signal ACT1, a source electrode of the eighth thin-film transistor M8 receives a high potential of power VDD, and a drain electrode of the eighth thin-film transistor M8 is electrically connected to the compensation module 2. A gate electrode of the ninth thin-film transistor M9 receives the second capacitance control signal ACT2, a source electrode of the ninth thin-film transistor M9 receives the high potential of power VDD, and a drain electrode of the ninth thin-film transistor M9 is electrically connected to the compensation module 2.

Specifically, in a preferred embodiment of the present disclosure, the compensation module 2 further includes a first thin-film transistor M1, a second thin-film transistor M2, and a third thin-film transistor M3, and the storage capacitor includes a first capacitor C1 and a second capacitor C2. A gate electrode of the first thin-film transistor M1 is electrically connected to a second end of the first capacitor C1, a source electrode of the first thin-film transistor M1 is electrically connected to a drain electrode of the second thin-film transistor M2, and a drain electrode of the first thin-film transistor M1 is electrically connected to a drain electrode of the third thin-film transistor M3. A gate electrode of the second thin-film transistor M2 receives the second control signal S2, and a source electrode of the second thin-film transistor M2 receives the data signal Data. A gate electrode of the third thin-film transistor M3 receives the second control signal S2, and a source electrode of the third thin-film transistor M3 is electrically connected to the gate electrode of the first thin-film transistor M1. A first end of the first capacitor C1 is electrically connected to the drain electrode of the eighth thin-film transistor M8, and a second end of the first capacitor C1 is electrically connected to the gate electrode of the first thin-film transistor M1. A first end of the second capacitor C2 is electrically connected to the drain electrode of the ninth thin-film transistor M9, and the second end of the second capacitor C2 is electrically connected to the gate electrode of the first thin-film transistor M1.

Further, a capacitance value of the first capacitor C1 is greater than a capacitance value of the second capacitor C2. When a refresh frequency of the OLED display panel is less than or equal to 60 Hz, the eighth thin-film transistor M8 and the ninth thin-film transistor M9 are controlled by the first capacitance control signal ACT1 and the second capacitance control signal ACT2 to be both turned on. When the refresh frequency of the OLED display panel is greater than 60 Hz and is less than or equal to 90 Hz, the eighth thin-film transistor M8 is controlled by the first capacitance control signal ACT1 to be turned on, and the ninth thin-film transistor M9 is controlled by the second capacitance control signal ACT2 to be turned off. When the refresh frequency of the OLED display panel is greater than 90 Hz, the eighth thin-film transistor M8 is controlled by the first capacitance control signal ACT1 to be turned off, and the ninth thin-film transistor M9 is controlled by the second capacitance control signal ACT2 to be turned on.

It needs to be stated that, refresh frequencies of 30 Hz, 60 Hz, 90 Hz, and 120 Hz are often used in the OLED display panel. As mentioned above, for OLED display panels with 30 Hz and 60 Hz, the present disclosure configures the first capacitance control signal ACT1 and the second capacitance control signal ACT2 to turn on the eighth thin-film transistor M8 and the ninth thin-film transistor M9. At this time, the first capacitor C1 and the second capacitor C2 are both turned on, the value of the storage capacitor in the compensation module 2 is the sum of capacitance values of the first capacitor C1 and the second capacitor C2. For OLED display panels with 90 Hz, the present disclosure configures the first capacitance control signal ACT1 to turn on the eighth thin-film transistor M8, and configures the second capacitance control signal ACT2 to turn off the ninth thin-film transistor M9. Because the first capacitor C1 is turned on, and because the second capacitor C2 is turn off, the value of the storage capacitor in the compensation module 2 is equal to the capacitance value of the first capacitor C1. For OLED display panels with 120 Hz, the present disclosure configures the first capacitance control signal ACT1 to turn off the eighth thin-film transistor M8, and configures the second capacitance control signal ACT2 to turn on the ninth thin-film transistor M9. Because the first capacitor C1 is turned off, and because the second capacitor C2 is turn on, the value of the storage capacitor in the compensation module 2 is equal to the capacitance value of the second capacitor C2. Thus, in the present disclosure, the first capacitor C1 and the second capacitor C2 are controlled by the first capacitance control signal ACT1 and the second capacitance control signal ACT2 to be turned on or off, causing the value of the storage capacitor in the compensation module 2 to be reduced with increase in refresh frequency, preventing insufficient charging of the storage capacitor due to an increasing refresh frequency.

Further, in a preferred embodiment of the present disclosure, the eighth thin-film transistor M8 and the ninth thin-film transistor M9 are both P-type thin-film transistors. When a refresh frequency of the OLED display panel is less than or equal to 60 Hz, potential of the first capacitance control signal ACT1 and the second capacitance control signal ACT2 are both low. When the refresh frequency of the OLED display panel is greater than 60 Hz and is less than or equal to 90 Hz, potential of the first capacitance control signal ACT1 is low, and potential of the second capacitance control signal ACT2 is high. When the refresh frequency of the OLED display panel is greater than 90 Hz, potential of the first capacitance control signal ACT1 is high, and potential of the second capacitance control signal ACT2 is low.

Specifically, in a preferred embodiment of the present disclosure, the restoration module 1 includes a fourth thin-film transistor M4 and a seventh thin-film transistor M7. A gate electrode of the fourth thin-film transistor M4 receives the first control signal S1, a source electrode of the fourth thin-film transistor M4 receives the restoration voltage VI, and a drain electrode of the fourth thin-film transistor M4 is electrically connected to the gate electrode of the first thin-film transistor. A gate electrode of the seventh thin-film transistor M7 receives the first control signal S1, a source electrode of the seventh thin-film transistor M7 receives the restoration voltage VI, and a drain electrode of the seventh thin-film transistor M7 is electrically connected to the light-emitting module 3.

Specifically, in a preferred embodiment of the present disclosure, the light-emitting module 3 includes a fifth thin-film transistor M5, a sixth thin-film transistor M6, and an organic light-emitting diode D1.

A gate electrode of the fifth thin-film transistor M5 receives the third control signal S3, a source electrode of the fifth thin-film transistor M5 receives the high potential of power VDD, and a drain electrode of the fifth thin-film transistor M5 is electrically connected to the drain electrode of the first thin-film transistor M1.

A gate electrode of the sixth thin-film transistor M6 receives the third control signal S3, a source electrode of the sixth thin-film transistor M6 is electrically connected to the drain electrode of the first thin-film transistor M1, and a drain electrode of the sixth thin-film transistor M6 is electrically connected to an anode of the organic light-emitting diode D1.

The anode of the organic light-emitting diode D1 is electrically connected to the drain electrode of the seventh thin-film transistor M7, and a cathode of the organic light-emitting diode D1 receives a low potential of power VSS.

Specifically, in a preferred embodiment of the present disclosure, the first thin-film transistor M1, the second thin-film transistor M2, the third thin-film transistor M3, the fourth thin-film transistor M4, the fifth thin-film transistor M5, the sixth thin-film transistor M6, and the seventh thin-film transistor M7 are P-type thin-film transistors.

Further, potential of the first control signal S1, the second control signal S2, and the third control signal S3 cooperates with each other to cause the pixel driving circuit to progress into a restoration stage 10, a threshold voltage compensation stage 20, and a light-emitting stage 30 sequentially.

At the restoration stage 10, potential of the first control signal S1 is low, and potential of the second control signal S2 and the third control signal S3 is high.

At the threshold voltage compensation stage 20, potential of the second control signal S2 is low, and potential of the first control signal S1 and the third control signal S3 is high.

At the light-emitting stage 30, potential of the third control signal S3 is low, and potential of the first control signal S1 and the second control signal S2 is high.

Figure 2:
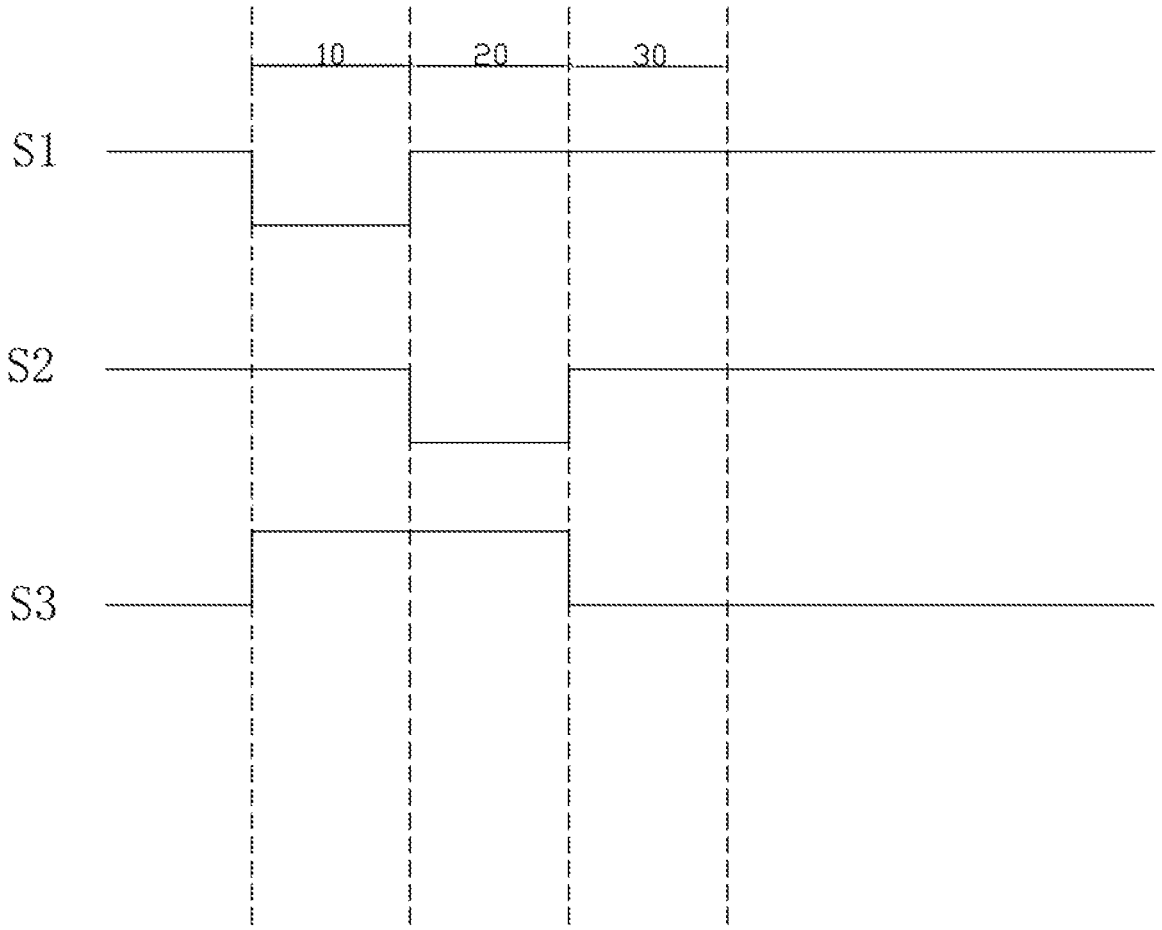
FIG. 2 is a timing diagram of a pixel driving circuit according to the present disclosure.

It needs to be stated that, in combination with FIG. 2, potential of the first control signal S1 is low at the restoration stage 10. Then, the fourth thin-film transistor M4 and the seventh thin-film transistor M7 are turned on, causing potential of the gate electrode of the first thin-film transistor M1 and the anode of the organic light-emitting diode D1 to be low. Thus, the storage capacitor is discharged.

At the threshold voltage compensation stage 20, potential of the second control signal S2 is low, and the second thin-film transistor M2 and the third thin-film transistor M3 are turned on. A short circuit connects the source electrode and the drain electrode of the first thin-film transistor M1, and potential of the gate electrode of the first thin-film transistor M1 satisfies the equation: $|VAI>|Vthl$. That is, the first thin-film transistor M1 becomes a diode. The first thin-film transistor M1 is turned on until the potential of the gate electrode of the first thin-film transistor M1 is equal to: Vdata-|Vthl, that is, in a cut-off state.

At the light-emitting stage 30, potential of the third control signal S3 is low, and the fifth thin-film transistor M5 and the sixth thin-film transistor M6 are turned on. A voltage Vgs between the gate electrode and the source electrode of the first thin-film transistor M1 is calculated by:

$$Vgs=Vdd-(Vdata-Vthl).$$

A current Ids flowing through the first thin-film transistor M1 is calculated by:

$$Ids=(1/2)K(Vdd-Vdata)^2;$$

where K is a characteristic constant of the first thin-film transistor M1, a current flowing through the organic light-emitting diode D1 is equal to Ids, threshold voltages of the first thin-film transistor M1 and the organic light-emitting diode D1 are not relevant to Ids, and the threshold voltages of the first thin-film transistor M1 and the organic light-emitting diode D1 receive compensation.

It is worth noting that the OLED display panel using the pixel driving circuit includes sub-pixels arranged in an array. A pixel driving circuit is disposed corresponding to each sub-pixel. A scanning line and a light-emitting signal line are disposed corresponding to each row of sub-pixels. A data line is disposed corresponding to each column of sub-pixels. Each scanning line outputs a scanning signal. Each light-emitting signal line outputs a light-emitting signal. Each data line outputs a data signal. In each pixel driving circuit, the first control signal is a scanning signal outputted by the previous row of scanning line, the second control signal is a scanning signal outputted by the present row of scanning line, the third control signal is a light-emitting signal outputted by the present row of light-emitting line, and the data signal is a data signal outputted by the present column of data line.

In conclusion, the present disclosure provides a pixel driving circuit for an OLED display panel, the pixel driving circuit including: a restoration module; a compensation module electrically connected to the restoration module, the compensation module including a storage capacitor; a light-emitting module electrically connected to the restoration module; and a storage capacitor control module electrically connected to the compensation module; wherein the restoration module is configured to receive a first control signal and a restoration voltage and be controlled by the first control signal to transmit the restoration voltage to the compensation module and the light-emitting module in order to restore the compensation module and the light-emitting module; wherein the compensation module is configured to receive a second control signal and be controlled by the second control signal to write a data signal and to compensate a threshold voltage; wherein the light-emitting module is configured to receive a third control signal and be controlled by the third control signal to illuminate; and wherein the storage capacitor control module is configured to adjust a capacitance value of the storage capacitor in the compensation module according to a difference of refresh frequencies of the OLED display panel. The present disclosure configures the storage capacitor control module to adjust the capacitance value of the storage capacitor in the compensation module according to the difference of refresh frequencies of the OLED display panel, preventing insufficient charging due to an increasing refresh frequency and thus improving stability of the pixel driving circuit.

A person of ordinary skill in the art is able to make modifications or changes corresponding to the foregoing description based on the technical solutions and the technical ideas of the present disclosure, and all of these modifications and changes should be within the protective scope of the appended claims of the present disclosure.

What is claimed is:

1. A pixel driving circuit for an organic light-emitting diode (OLED) display panel, the pixel driving circuit comprising:

a restoration module;

a compensation module electrically connected to the restoration module, the compensation module comprising a storage capacitor;

a light-emitting module electrically connected to the restoration module; and a storage capacitor control module electrically connected to the compensation module;

wherein the restoration module is configured to receive a first control signal and a restoration voltage and be controlled by the first control signal to transmit the restoration voltage to the compensation module and the light-emitting module in order to restore the compensation module and the light-emitting module;

wherein the compensation module is configured to receive a second control signal and be controlled by the second control signal to write a data signal and to compensate a threshold voltage;

wherein the light-emitting module is configured to receive a third control signal and be controlled by the third control signal to illuminate; and wherein the storage capacitor control module is configured to adjust a capacitance value of the storage capacitor in the compensation module according to a difference of refresh frequencies of the OLED display panel.

2. The pixel driving circuit of claim 1, wherein the storage capacitor control module receives a first capacitance control signal and a second capacitance control signal and adjusts the capacitance value of the storage capacitor in the compensation module by varying potential of the first capacitance control signal and the second capacitance control signal.

3. The pixel driving circuit of claim 2, wherein the storage capacitor control module comprises an eighth thin-film transistor and a ninth thin-film transistor;

wherein a gate electrode of the eighth thin-film transistor receives the first capacitance control signal, a source electrode of the eighth thin-film transistor receives a high potential of power, and a drain electrode of the eighth thin-film transistor is electrically connected to the compensation module; and wherein a gate electrode of the ninth thin-film transistor receives the second capacitance control signal, a source electrode of the ninth thin-film transistor receives the high potential of power, and a drain electrode of the ninth thin-film transistor is electrically connected to the compensation module.

4. The pixel driving circuit of claim 3, wherein the compensation module further comprises a first thin-film transistor, a second thin-film transistor, and a third thin-film transistor, and the storage capacitor comprises a first capacitor and a second capacitor;

wherein a source electrode of the first thin-film transistor is electrically connected to a drain electrode of the second thin-film transistor, and a drain electrode of the first thin-film transistor is electrically connected to a drain electrode of the third thin-film transistor;

wherein a gate electrode of the second thin-film transistor receives the second control signal, and a source electrode of the second thin-film transistor receives the data signal;

wherein a gate electrode of the third thin-film transistor receives the second control signal, and a source electrode of the third thin-film transistor is electrically connected to a gate electrode of the first thin-film transistor;

wherein a first end of the first capacitor is electrically connected to the drain electrode of the eighth thin-film transistor, and a second end of the first capacitor is electrically connected to the gate electrode of the first thin-film transistor; and wherein a first end of the second capacitor is electrically connected to the drain electrode of the ninth thin-film transistor, and a second end of the second capacitor is electrically connected to the gate electrode of the first thin-film transistor.

5. The pixel driving circuit of claim 4, wherein a capacitance value of the first capacitor is greater than a capacitance value of the second capacitor.

6. The pixel driving circuit of claim 5, wherein when a refresh frequency of the OLED display panel is less than or equal to 60 Hz, the eighth thin-film transistor and the ninth thin-film transistor are controlled by the first capacitance control signal and the second capacitance control signal to be both turned on;

wherein when the refresh frequency of the OLED display panel is greater than 60 Hz and is less than or equal to 90 Hz, the eighth thin-film transistor is controlled by the first capacitance control signal to be turned on, and the ninth thin-film transistor is controlled by the second capacitance control signal to be turned off; and wherein when the refresh frequency of the OLED display panel is greater than 90 Hz, the eighth thin-film transistor is controlled by the first capacitance control signal to be turned off, and the ninth thin-film transistor is controlled by the second capacitance control signal to be turned on.

7. The pixel driving circuit of claim 4, wherein the restoration module comprises a fourth thin-film transistor and a seventh thin-film transistor;

wherein a gate electrode of the fourth thin-film transistor receives the first control signal, a source electrode of the fourth thin-film transistor receives the restoration voltage, and a drain electrode of the fourth thin-film transistor is electrically connected to the gate electrode of the first thin-film transistor; and wherein a gate electrode of the seventh thin-film transistor receives the first control signal, a source electrode of the seventh thin-film transistor receives the restoration voltage, and a drain electrode of the seventh thin-film transistor is electrically connected to the light-emitting module.

8. The pixel driving circuit of claim 7, wherein the light-emitting module comprises a fifth thin-film transistor, a sixth thin-film transistor, and an organic light-emitting diode;

wherein a gate electrode of the fifth thin-film transistor receives the third control signal, a source electrode of the fifth thin-film transistor receives the high potential of power, and a drain electrode of the fifth thin-film transistor is electrically connected to the drain electrode of the first thin-film transistor;

wherein a gate electrode of the sixth thin-film transistor receives the third control signal, a source electrode of the sixth thin-film transistor is electrically connected to the drain electrode of the first thin-film transistor, and a drain electrode of the sixth thin-film transistor is electrically connected to an anode of the organic light-emitting diode; and wherein the anode of the organic light-emitting diode is electrically connected to the drain electrode of the seventh thin-film transistor, and a cathode of the organic light-emitting diode receives a low potential of power.

9. The pixel driving circuit of claim 8, wherein the first thin-film transistor, the second thin-film transistor, the third thin-film transistor, the fourth thin-film transistor, the fifth thin-film transistor, the sixth thin-film transistor, and the seventh thin-film transistor are P-type thin-film transistors.

10. The pixel driving circuit of claim 9, wherein potential of the first control signal, the second control signal, and the third control signal cooperates with each other to cause the pixel driving circuit to progress into a restoration stage, a threshold voltage compensation stage, and a light-emitting stage sequentially;

wherein at the restoration stage, potential of the first control signal is low, and potential of the second control signal and the third control signal is high;

wherein at the threshold voltage compensation stage, potential of the second control signal is low, and potential of the first control signal and the third control signal is high; and wherein at the light-emitting stage, potential of the third control signal is low, and potential of the first control signal and the second control signal is high.

* * * * *